US008203415B2

(12) United States Patent
Wu et al.

(10) Patent No.: US 8,203,415 B2
(45) Date of Patent: Jun. 19, 2012

(54) BOBBIN STRUCTURE AND TRANSFORMER HAVING THE SAME

(75) Inventors: Tsung-Hsiao Wu, Taoyuan Hsien (TW); Kao-Tsai Liao, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/948,559

(22) Filed: Nov. 17, 2010

(65) Prior Publication Data

US 2011/0115598 A1 May 19, 2011

(30) Foreign Application Priority Data

Nov. 19, 2009 (TW) ..... 98139401 A

(51) Int. Cl.
*H01F 27/30* (2006.01)
*H01F 21/06* (2006.01)
*H01F 27/24* (2006.01)

(52) U.S. Cl. ..... 336/198; 336/136; 336/208; 336/212

(58) Field of Classification Search ..... 336/136, 336/198, 208, 212
See application file for complete search history.

(56) References Cited

U.S. PATENT DOCUMENTS 4,462,016 A * 7/1984 Bland et al. ..... 336/192
2008/0284551 A1* 11/2008 Chen et al. ..... 336/182

* cited by examiner

*Primary Examiner* — Anh Mai
*Assistant Examiner* — Ronald Hinson
(74) *Attorney, Agent, or Firm* — Kirton McConkie; Evan R. Witt

(57) ABSTRACT

A bobbin structure is disclosed. The bobbin structure comprises plural modular bobbin members each connected with each other. Each modular bobbin member comprises a perforation channel, a first baffle disposed on one end of the perforation channel and placed perpendicularly to the perforation channel, and a second baffle disposed on the other end of the perforation channel and placed oppositely to the first baffle. The first baffle has a first connecting member, and the second baffle has a second connecting member. A first winding slot is disposed between the first baffle and the second baffle. The bobbin structure is formed by the engagement between the first connecting member of one modular bobbin member and the second connecting member of another connected one, wherein a second winding slot is formed between two connected modular bobbin members.

20 Claims, 7 Drawing Sheets

BOBBIN STRUCTURE AND TRANSFORMER HAVING THE SAME

FIELD OF THE INVENTION

The present invention relates to a bobbin structure and a magnetic component containing such bobbin structure, and more particularly to an improved bobbin structure with plural modular bobbin members and a transformer containing such improved bobbin structure.

BACKGROUND OF THE INVENTION

In electrical applications there have been developed various tailor-made types of bobbins which can be provided to use with different magnetic components, such as a transformer. As is well known to the industry, when it comes to fabricating phase, there will be always some hurdles given by the recent design trend needed to overcome, such as the requirements for high-density, economic fabrication, etc.

Some similar solutions are developed. For example, one of the conventional transformers is illustrated as in FIG. 1 and FIG. 2 which respectively illustrate an exploded view and an assembled view of such. As shown in FIG. 1, the way to form the conventional transformer 10 is to make a portion of a magnetic core 11, in this case a central post of the magnetic core 11, penetrate through a bobbin structure including three different bobbin members which are a first bobbin member 21, a second bobbin member 22, and a third bobbin member 23. A primary winding coil (not shown) is respectively wound on a first lateral slot 213 of the first bobbin member 21, a first winding slot 311 disposed between a first baffle 41 and a second baffle 42, and a second lateral slot 231 of the third bobbin member 23. The secondary winding coil 32 is respectively wound on between the first bobbin member 21 and the second bobbin member 22, and between the second bobbin member 22 and the third bobbin member 23.

A perforation channel 211 of the first bobbin member 21 is provided to be penetrated through by the inserted portion of the magnetic core 11, and an insulating sleeve 212 of the first bobbin member 21 enclosing and defining the perforation channel 211 accommodates the inserted portion of the magnetic core 11 to insulate the same from other wound components so as to form a finished transformer as shown in FIG. 2.

The first bobbin member 21 illustrated as in FIG. 3 plays a significant role in a conventional bobbin structure. The bobbin structure is formed by means of penetrating the insulating sleeve 212 of the first bobbin member 21 through the bodies of the second bobbin member 22 and the third bobbin member 23. As shown, the insulating sleeve 212 encloses and defines the perforation channel 211 in which a portion of the magnetic core 11 penetrates. In particular, the insulating sleeve 212 enclosing and defining the perforation channel 211 has a thickness "A" of around 0.08 mm. That means certain winding depth is unused and waste. In other words, the winding depth of the specific areas, such as the first lateral slot 213, the first winding slot 311 and the second lateral slot 231, is limited resulting in the decreasing of winding counts thereof. That will certainly reduce the performance and efficiency of a magnetic component.

Based upon the foregoing, there is an issue of economic fabrication arising from several different modules of bobbin member being used in the conventional way. In particular, each bobbin member module is unique in construction and couldn't be exchanged for another in use. That is disadvantageous since the conventional way may increase additional efforts to build, manage, stock, and assemble those different bobbin member modules with the fabricating cost significantly rising. In addition, there is another disadvantage arising from the reducing of the winding depth of the winding coil due to the inherent limitation in question. The product also may result in failure to compete in size under the high-density requirement. Apparently, a bobbin structure which is capable to meet the needs for increasing performance, design flexibility and simpler construction, and for reducing fabrication costs is in demand.

SUMMARY OF THE INVENTION

It is an object of an embodiment of the present invention to provide a bobbin structure and a transformer having such bobbin structure in which the bobbin structure is of simple construction by use of a plurality of modular bobbin member so as to achieve the economic fabrication.

It is another object of an embodiment of the present invention to provide a bobbin structure and a transformer having such bobbin structure in which the bobbin structure may have an optimal availability for winding so as to improve the performance and the efficiency thereof.

It is another object of an embodiment of the present invention to provide a bobbin structure and a transformer having such bobbin structure in which the size of the bobbin structure is reduced so as to meet design flexibility and high-density requirements.

In accordance with an aspect of the present invention, there is provided a bobbin structure comprising a plurality of modular bobbin members each connected with each other. Each modular bobbin member comprises a perforation channel, a first baffle disposed on one end of the perforation channel and placed perpendicularly to the perforation channel, and a second baffle disposed on the other end of the perforation channel and placed oppositely to the first baffle. The first baffle has a first connecting member, and the second baffle has a second connecting member. A first winding slot is disposed between the first baffle and the second baffle. The first connecting member and the second connecting member are each configured to be corresponsive and complementary to the other. The bobbin structure is formed by the engagement between the first connecting member of one modular bobbin member and the second connecting member of another connected one, wherein a second winding slot is formed between two connected modular bobbin members. The first connecting member and the second connecting member may sufficiently form an insulating bottom wall of the second winding slot by way of this engagement so as to insulate an embedded winding coil from a magnetic core.

In a preferred embodiment, the first baffle has a first extension portion, and the second baffle has a second extension portion. A third connecting member on the first extension portion and a fourth connecting member on the second extension portion could be provided. The third connecting member and the forth connecting member are each configured to be corresponsive and complementary to the other. The third connecting member and the forth connecting member are engaged with each other when the first connecting member and the second connecting member are engaged with each other.

In accordance with an aspect of the present invention, there is provided a transformer comprising the bobbin structure wound by a primary winding coil and a secondary winding coil, and a magnetic core. The bobbin structure of this invention is described as above. The primary winding coil is wound on the first winding slot, and the secondary winding coil is wound on the second winding slot. The magnetic core is partially embedded in the perforation channel and incorporated with the plurality of modular bobbin members. In a preferred embodiment, the transformer is to use for a switching power supply.

It is easily to be understood that the insulating sleeve in the prior art is eliminated resulting in a smaller bobbin size in the present invention, and the simpler construction of the modular bobbin member may effectively reduce lots of design and fabrication efforts making the bobbin structure capable to achieve the economic fabrication.

These and various other features and advantages which characterize the present invention are particularly underlined in the claims annexed hereto and form a part hereof. As such, the present invention will become best understood through the following detailed descriptions with reference to the accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
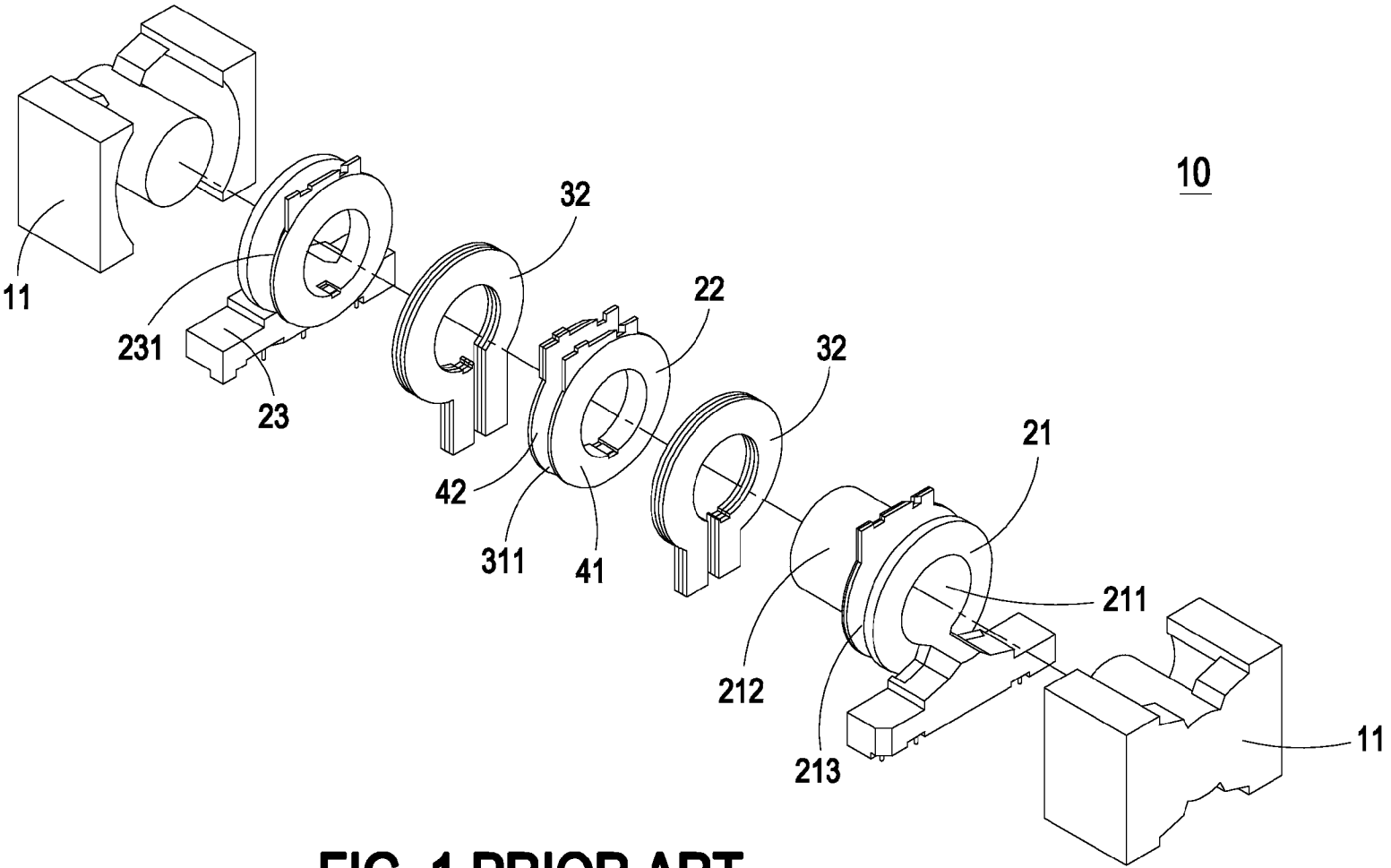
FIG. 1 PRIOR ART
FIG. 1 is an exploded view schematically showing a conventional transformer.
Figure 2:
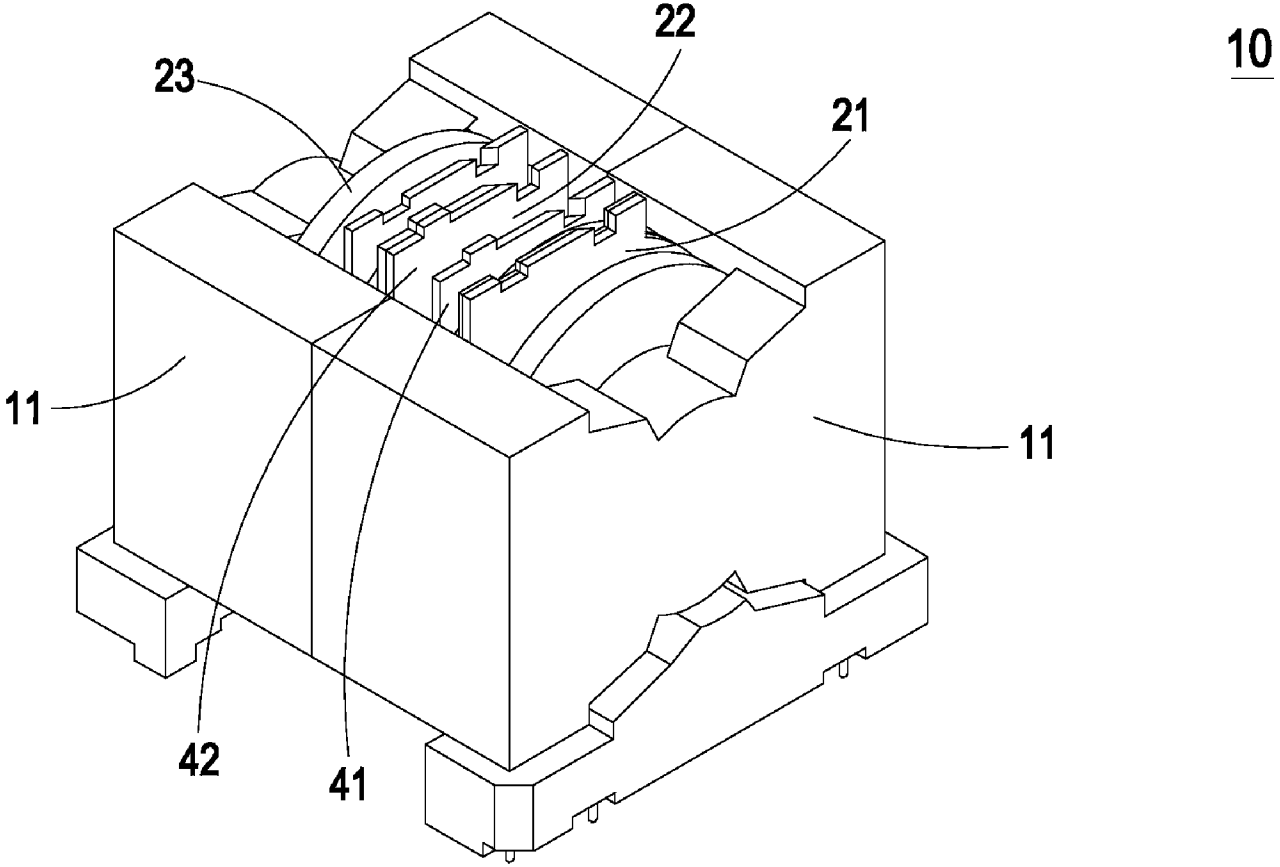
FIG. 2 PRIOR ART
FIG. 2 is an assembled view schematically showing the same as in FIG. 1.
Figure 3:
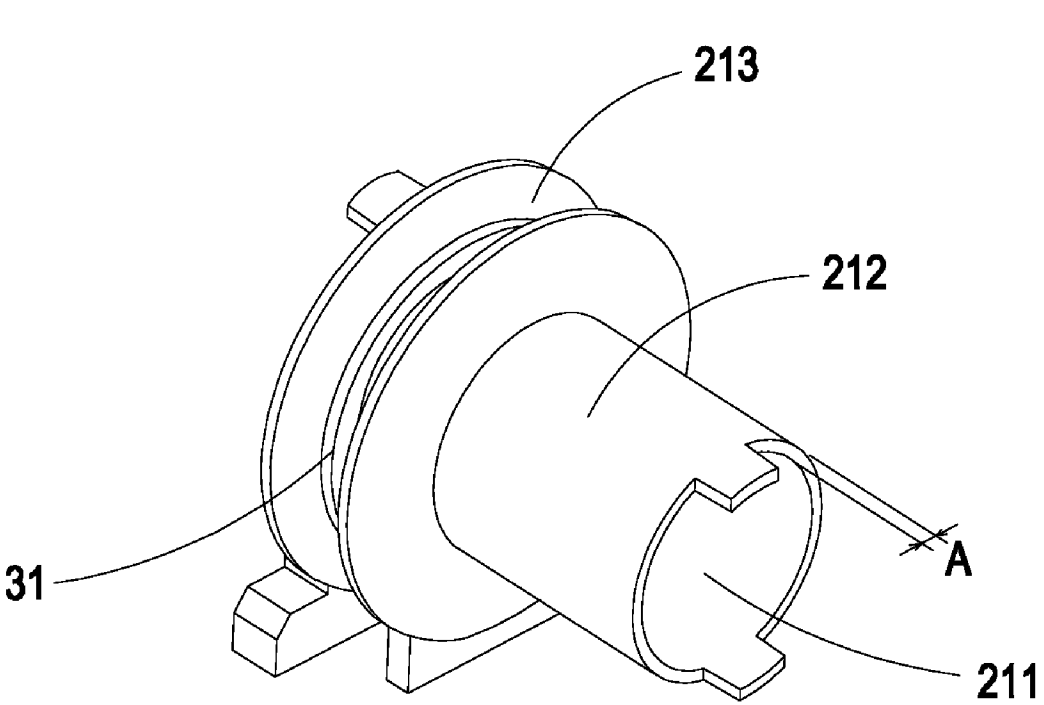
FIG. 3 PRIOR ART
FIG. 3 illustrates a front and top view schematically showing a first bobbin member which is used in a conventional transformer as in FIG. 1 and FIG. 2.
Figure 4B:
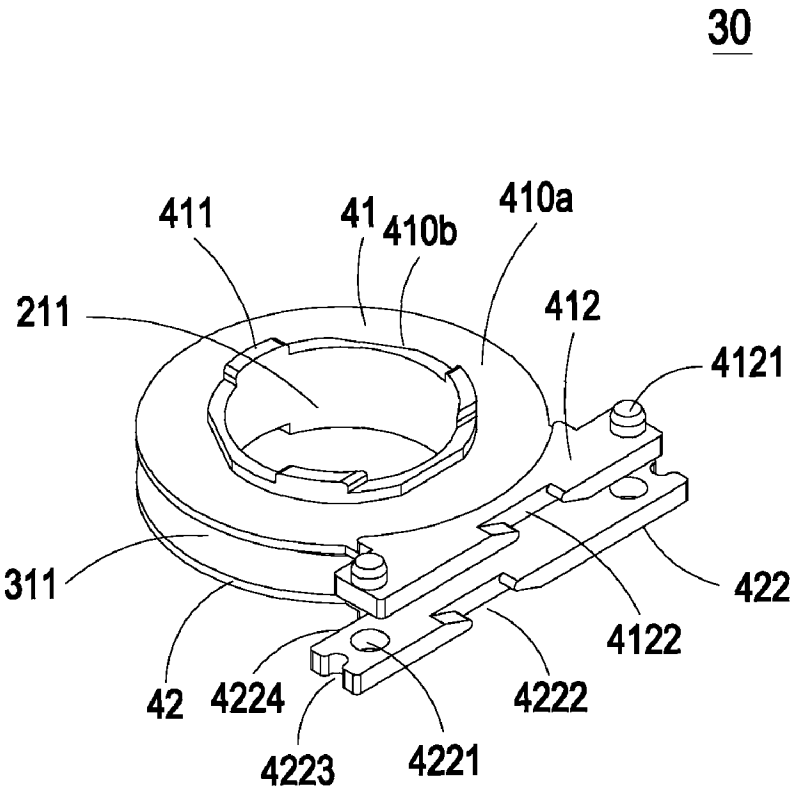
FIG. 4B illustrates a back view schematically showing the same as in FIG. 4A.
Figure 4A:
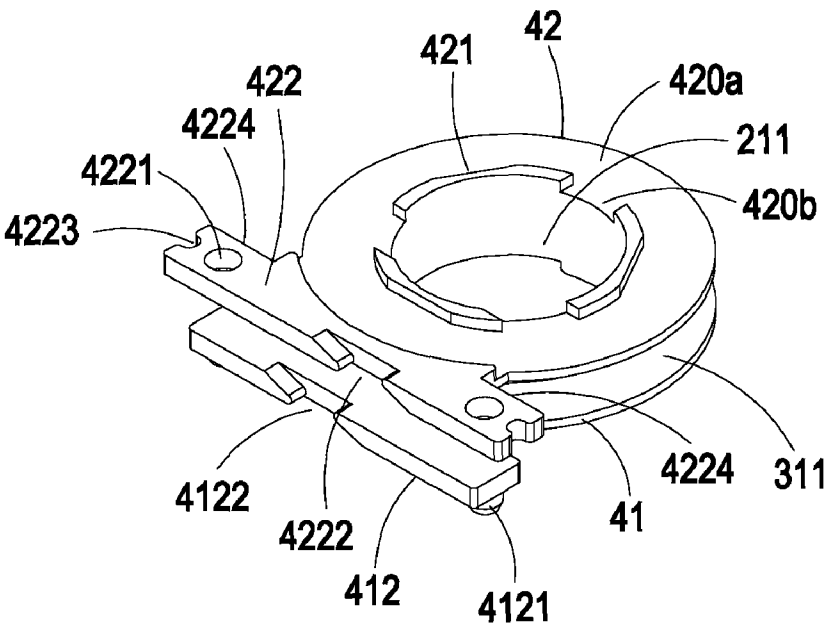
FIG. 4A illustrates a front view schematically showing a modular bobbin member according to one embodiment of the invention.

FIG. 4A and FIG. 4B respectively illustrate a front view and a back view of a modular bobbin member according to one embodiment of the invention. The modular bobbin member 30 comprises a perforation channel 211 being room shaped in a right circular cylinder, a first baffle 41 disposed on one end of the perforation channel 211 and placed perpendicularly to the perforation channel 211, a second baffle 42 disposed on the other end of the perforation channel 211 and placed oppositely to the first baffle 41, and a first winding slot 311 is disposed between the first baffle 41 and the second baffle 42 for accommodating a primary winding coil. The first baffle 41 has a first connecting member 411 disposed on a first abutment 410*b* of a first outer wall 410*a*, and the second baffle 42 has a second connecting member 421 disposed on a second abutment 420*b* of a second outer wall 420*a* and configured to cooperate with the first connecting member 411. The first connecting member 411 and the second connecting member 421 are each configured to be corresponsive and complementary to the other. In this embodiment, the first connecting member 411 is a plurality of protrusions, and the second connecting member 421 is a plurality of recesses formed between the plurality of protrusions. In particular, the plurality of protrusions and the plurality of recesses of either the first connecting member 411 or the second connecting member 421 are each configured to be corresponsive and complementary to the other. However, it is easily to be understood that the engagement type and the arrangement between the first connecting member 411 and the second connecting member 421 may alternatively change, be reverse. The engagement result between the first connecting member 411 and the second connecting member 421 could be achieved in many ways known to those skilled in the art.

The first baffle 41 has a first extension portion 412, and the second baffle 42 has a second extension portion 422. The first extension portion 412 has a third connecting member 4121, and the second extension portion 422 has a fourth connecting member 4221. The third connecting member 4121 and the fourth connecting member 4221 are each configured to be corresponsive and complementary to the other. In this embodiment, the third connecting member 4121 is two protrusions extending outwardly from the first outer wall 410*a*, and the fourth connecting member 4221 is two holes. Again, it is easily to be understood that the engagement type and the arrangement between the third connecting member 4121 and the fourth connecting member 4221 may alternatively change, be reverse. The engagement result between the third connecting member 4121 and the fourth connecting member 4221 could be achieved in many ways known to those skilled in the art.

As illustrated in this preferred embodiment, the first connecting member 411 and the second connecting member 421 of one modular bobbin member 30 are different from each other but they are configured to be corresponsive and complementary to each other, such that one modular bobbin member 30 is capable to be connected with another one 30 so as to form a bobbin structure. Likewise, the engagement between the third connecting member 4121 and the fourth connecting member 4221 employing the same rationale is further provided to help the connection between two connected modular bobbin members.

For providing the communication routes for the winding coils wound on the bobbin structure, a first guiding slot 4122 and a second guiding slot 4222 are provided and respectively placed on the same lateral ends of the first extension portion 412 and the second extension portion 422.

A clamping member 4224 for securing the modular bobbin member 30 to a magnetic core is placed on two opposite sides of the second extension portion 422. In addition to the first guiding slot 4122 and the second guiding slot 4222, a third guiding slot 4223 is placed on one end of one said clamping member 4224 for providing one another communication route for the winding coils wound on the bobbin structure.

Figure 5:
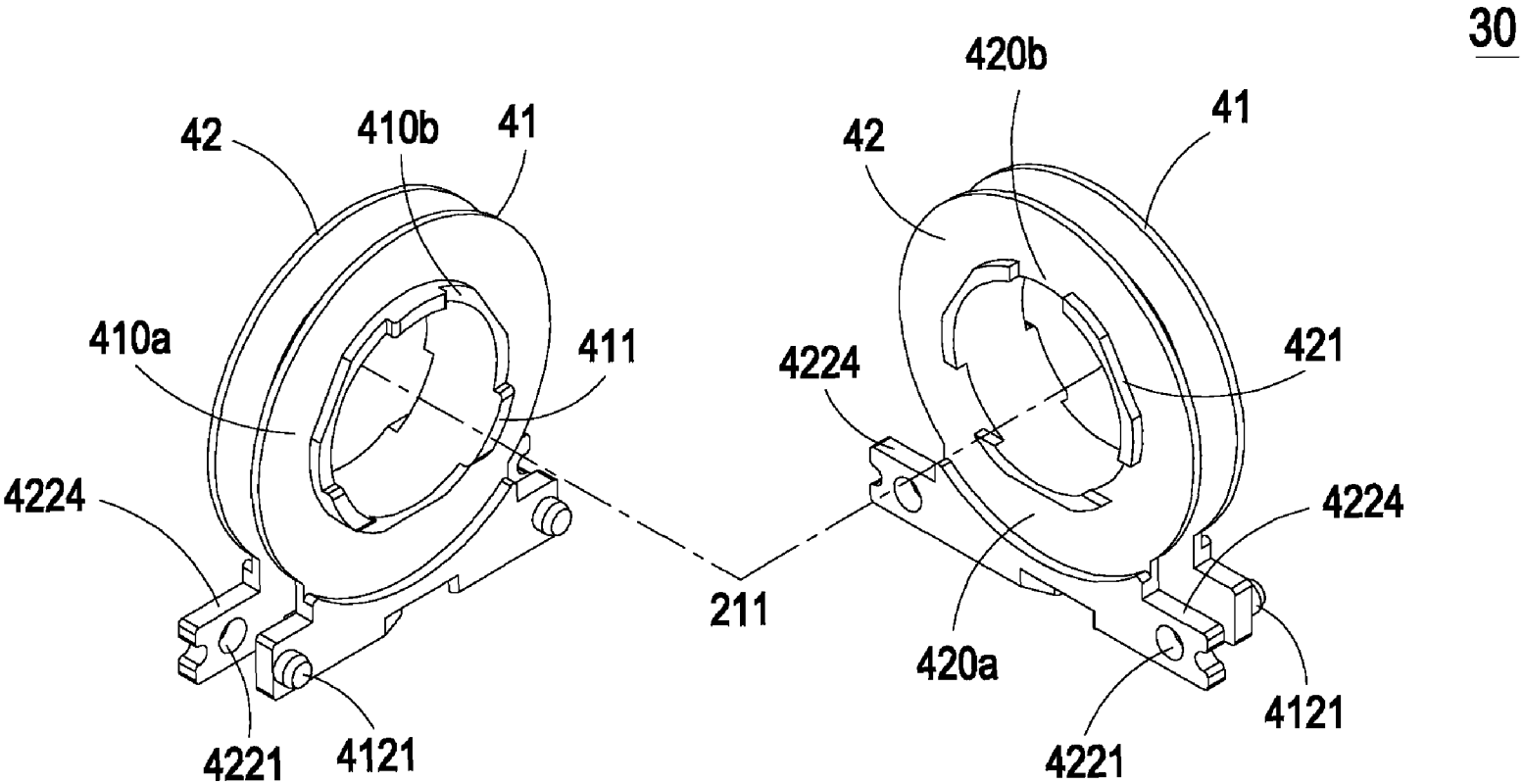
FIG. 5 illustrates an exploded view schematically showing a plurality of modular bobbin members according to one embodiment of the invention.
Figure 6:
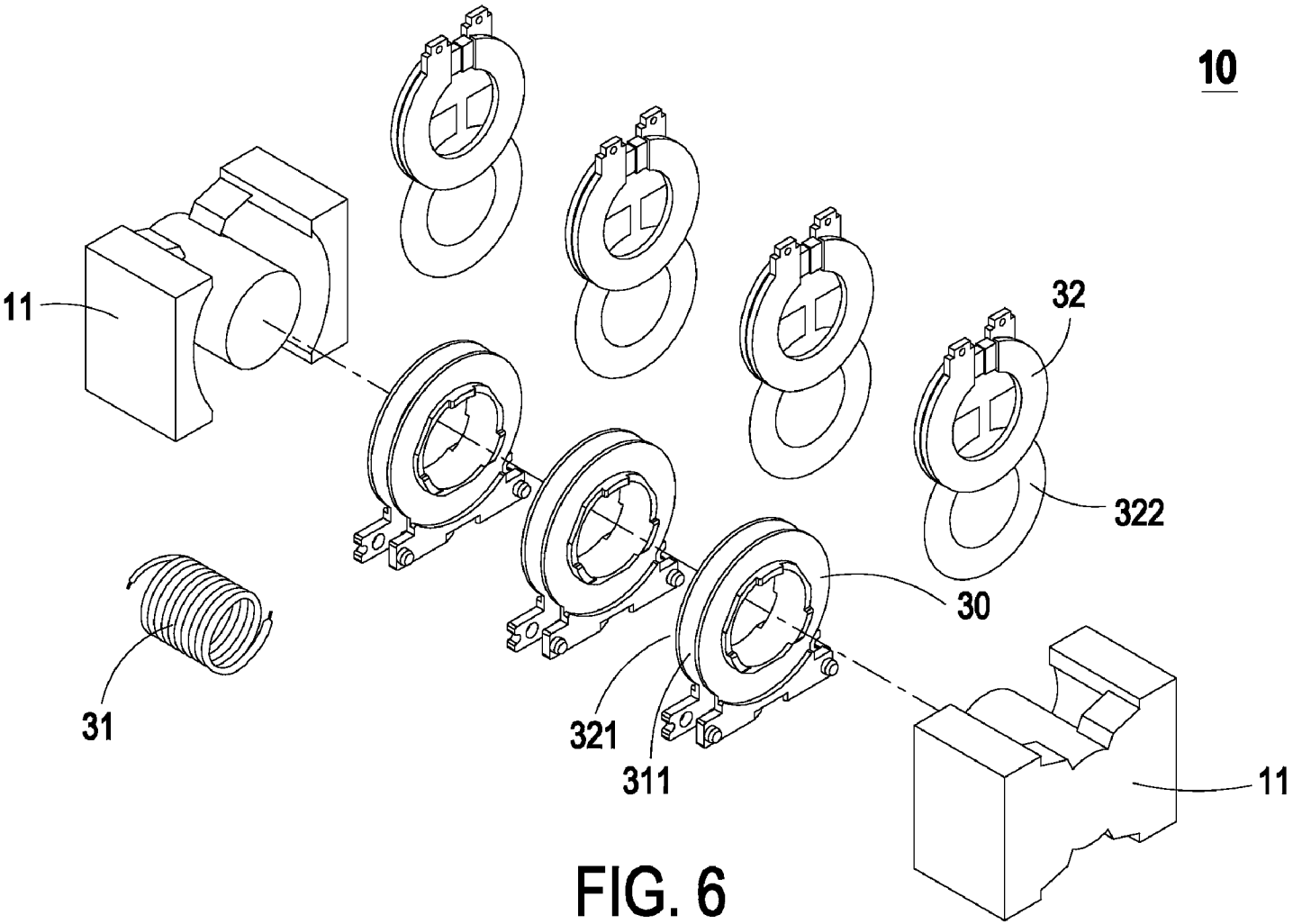
FIG. 6 is an exploded view schematically showing a transformer according to one embodiment of the invention.

FIG. 5 illustrates a plurality of modular bobbin members according to one embodiment of the invention. The plurality of modular bobbin members are each connected to each other so as to form a bobbin structure. More specifically, the bobbin structure is constructed by the engagement between the first connecting member 411 of one modular bobbin member 30 and the second connecting member 421 of another connected one 30, wherein a second winding slot 321 (as shown in FIG. 6) for accommodating a secondary winding coil is formed and positioned between two connected said modular bobbin members. In a preferred embodiment, the first connecting member 411 and the second connecting member 421 may sufficiently form an insulating bottom wall of the second winding slot 321 by way of this engagement so as to insulate an embedded winding coil from a magnetic core.

Figure 7:
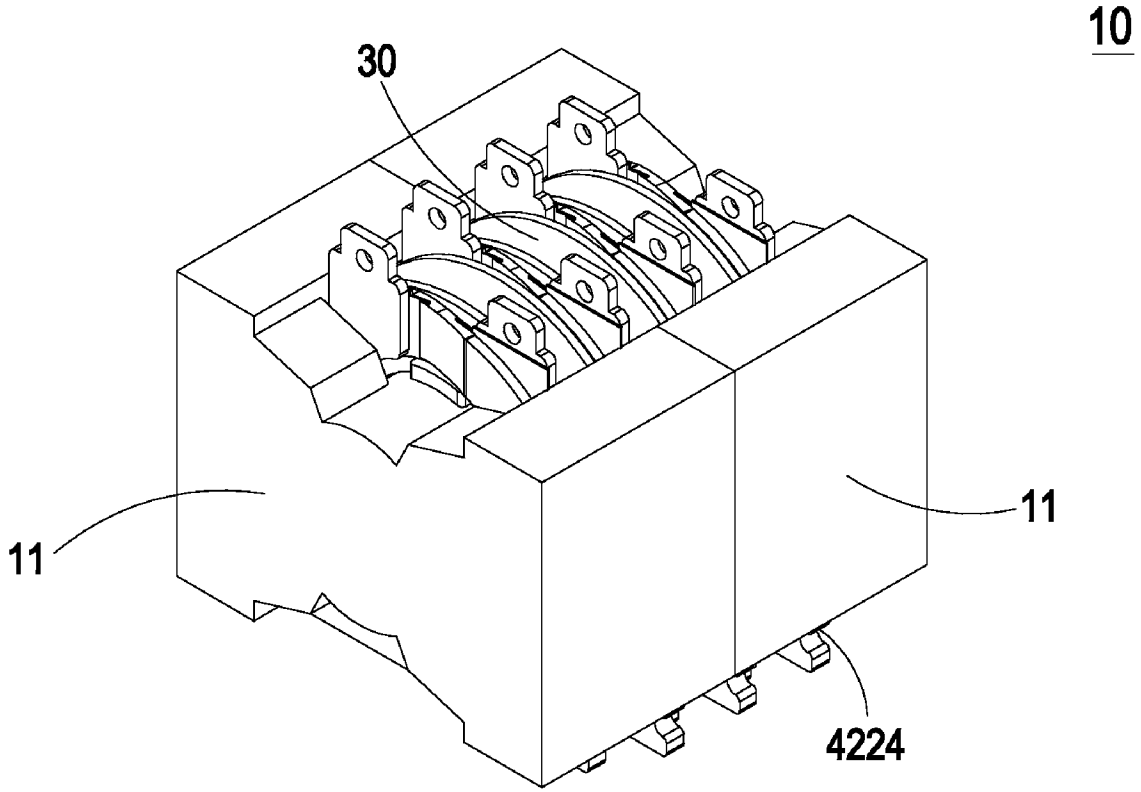
FIG. 7 is an assembled view schematically showing the same as in FIG. 6.

According to the invention, there is provided a transformer as illustrated in FIG. 6 and FIG. 7. The transformer 10 comprises the plurality of modular bobbin members as described above, a magnetic core 11, a primary winding coil 31 accommodated by the first winding slot 311, a secondary winding coil 32 accommodated by the second winding slot 321, and an insulating sheet 322. In the final stage of construction, a portion of the magnetic core 11 is inserted into the perforation channel 211 (as shown in FIG. 5), and the magnetic core 11 is incorporated with the plurality of modular bobbin members. The secondary winding coil 32 can be formed by conductive foil laminate, such as a copper laminate. In this embodiment, it is formed by multiple layers of conductive foil laminate. Each layer of the multiple layers of conductive foil laminate is separated by an insulating sheet 322 from another layer. The clamping member 4224 of each modular bobbin member 30 is engaged with one portion of the magnetic core 11 for securing the modular bobbin member 30 to the magnetic core 11. The transformer as illustrated herein is provided to be use with various electronic devices, such as a switching power supply.

In a preferred embodiment, the magnetic core is a ferrite core and is one of a PJ type, a PQ type, an EQ type, an RM type, an ER type, and a PM type magnetic core in shape.

According to the invention, the bobbin structure and the transformer as presented herein having modular and simpler construction are advantageous to obtain economic fabrication, meet design flexibility and high-density requirements, and improve the performance and efficiency thereof.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A bobbin structure comprising:

a plurality of modular bobbin members, each connected with each other, and each modular bobbin member comprising:

a perforation channel;

a first baffle disposed on one end of said perforation channel and placed perpendicularly to said perforation channel, having a first connecting member positioned on a first outer wall of said first baffle;

a second baffle disposed on the other end of said perforation channel and placed oppositely to said first baffle, having a second connecting member positioned on a second outer wall of said second baffle and configured to cooperate with said first connecting member; and a first winding slot disposed between said first baffle and said second baffle, accommodating a primary winding coil; and wherein said first connecting member of one said modular bobbin member is engaged with said second connecting member of another connected one, a second winding slot accommodating a secondary winding coil is positioned between two connected said modular bobbin members, and said first connecting member and said second connecting member sufficiently form an insulating bottom wall of said second winding slot for insulating said secondary winding coil from a magnetic core partially embedded in said perforation channel.

2. The bobbin structure according to claim 1 wherein said perforation channel is room shaped in a right circular cylinder.

3. The bobbin structure according to claim 1 wherein said first connecting member and said second connecting member are respectively disposed on a first abutment of said first outer wall and a second abutment of said second outer wall.

4. The bobbin structure according to claim 1 wherein each of said first connecting member and said second connecting member is a plurality of protrusions and a plurality of recesses formed between said plurality of protrusions, wherein said plurality of protrusions and said plurality of recesses of either said first connecting member or said second connecting member are each configured to be corresponsive and complementary to the other.

5. The bobbin structure according to claim 1 wherein said first baffle and said second baffle respectively comprise a first extension portion and a second extension portion.

6. The bobbin structure according to claim 5 wherein said first extension portion and said second extension portion respectively comprise a third connecting member and a fourth connecting member, wherein said third connecting member and said fourth connecting member are each configured to be corresponsive and complementary to the other.

7. The bobbin structure according to claim 6 wherein said third connecting member is two protrusions extending outwardly from said first outer wall, and said fourth connecting member is two holes.

8. The bobbin structure according to claim 5 wherein on the same lateral ends of said first extension portion and said second extension portion are respectively placed a first guiding slot and a second guiding slot.

9. The bobbin structure according to claim 5 wherein on two opposite sides of said second extension portion is placed a clamping member for securing said modular bobbin member to a magnetic core.

10. The bobbin structure according to claim 9 wherein on one end of one said clamping member is placed a third guiding slot.

11. A transformer comprising:

a bobbin structure comprising:

a plurality of modular bobbin members, each connected with each other, and each modular bobbin member comprising:

a perforation channel;

a first baffle disposed on one end of said perforation channel and placed perpendicularly to said perforation channel, having a first connecting member positioned on a first outer wall of said first baffle;

a second baffle disposed on the other end of said perforation channel and placed oppositely to said first baffle, having a second connecting member positioned on a second outer wall of said second baffle and configured to cooperate with said first connecting member; and a first winding slot disposed between said first baffle and said second baffle, accommodating a primary winding coil; and wherein said first connecting member of one said modular bobbin member is engaged with said second connecting member of another connected one, and a second winding slot accommodating a secondary winding coil is positioned between two connected said modular bobbin members; and a magnetic core partially embedded in said perforation channel and incorporated with said plurality of modular bobbin members;

wherein said first connecting member and said second connecting member sufficiently form an insulating bottom wall of said second winding slot for insulating said secondary winding coil from said magnetic core.

12. The transformer according to claim 11 wherein said first connecting member and said second connecting member are respectively disposed on a first abutment of said first outer wall and a second abutment of said second outer wall.

13. The transformer according to claim 11 wherein said first baffle and said second baffle respectively comprise a first extension portion and a second extension portion.

14. The transformer according to claim 13 wherein said first extension portion and said second extension portion respectively comprise a third connecting member and a fourth connecting member, wherein said third connecting member and said fourth connecting member are each configured to be corresponsive and complementary to the other.

15. The transformer according to claim 14 wherein said third connecting member is two protrusions extending outwardly from said first outer wall, and said fourth connecting member is two holes.

16. The transformer according to claim 13 wherein on the same lateral ends of said first extension portion and said second extension portion are respectively placed a first guiding slot and a second guiding slot.

17. The transformer according to claim 13 wherein on two opposite sides of said second extension portion is placed a clamping member engaged with one portion of said magnetic core for securing said modular bobbin member to said magnetic core.

18. The transformer according to claim 17 wherein on one end of one said clamping member is placed a third guiding slot.

19. The transformer according to claim 11 wherein said secondary winding coil is formed by multiple layers of conductive foil laminate, wherein each layer of said multiple layers of conductive foil laminate is separated by an insulating sheet from another layer.

20. The transformer according to claim 11 wherein said magnetic core is a ferrite core and is one of a PJ type, a PQ type, an EQ type, an RM type, an ER type, and a PM type magnetic core in shape.

* * * * *